US008453634B2

(12) United States Patent
Chen

(10) Patent No.: US 8,453,634 B2
(45) Date of Patent: Jun. 4, 2013

(54) INITIAL VELOCITY ACCELERATING TUBE

(75) Inventor: Jeffrey Chen, Shalu Township, Taichung County (TW)

(73) Assignee: J.B. Unicorn Ltd., Taichung County (TW)

( * ) Notice: Subject to any disclaimer, the term of this patent is extended or adjusted under 35 U.S.C. 154(b) by 326 days.

(21) Appl. No.: 12/904,246

(22) Filed: Oct. 14, 2010

(65) Prior Publication Data

US 2012/0090588 A1 Apr. 19, 2012

(51) Int. Cl.
*F41B 11/12* (2006.01)
*F41A 21/48* (2006.01)
*F41B 11/00* (2006.01)

(52) U.S. Cl.
CPC ..... *F41B 11/00* (2013.01); *F41A 21/48* (2013.01)
USPC ..... 124/85; 124/83; 42/75.02

(58) Field of Classification Search
CPC ..... F41B 11/00; F41A 21/48
USPC ..... 124/83, 85; 42/75.02
See application file for complete search history.

(56) References Cited

U.S. PATENT DOCUMENTS 1,393,057 A * 10/1921 Vollmer ..... 89/16
1,494,524 A * 5/1924 Adamson ..... 89/16
2,736,117 A * 2/1956 Clarkson et al. ..... 42/75.02
3,442,172 A * 5/1969 Lorenzet al. ..... 89/16
4,120,276 A * 10/1978 Curran ..... 124/85
4,307,666 A * 12/1981 Baran ..... 102/525
4,833,810 A * 5/1989 Domian ..... 42/59
5,433,133 A * 7/1995 La France ..... 89/14.2
5,572,982 A * 11/1996 Williams ..... 124/74
5,673,679 A * 10/1997 Walters ..... 124/53.5
5,685,102 A * 11/1997 Latka ..... 42/85
5,819,715 A * 10/1998 Haneda et al. ..... 124/6
6,273,080 B1 * 8/2001 Sullivan, Jr. ..... 124/84
6,295,752 B1 * 10/2001 Havlock ..... 42/76.01
6,311,683 B1 * 11/2001 Lee ..... 124/71
6,494,195 B2 * 12/2002 Perry et al. ..... 124/84
6,655,372 B1 * 12/2003 Field et al. ..... 124/83
6,668,815 B1 * 12/2003 Fernandez ..... 124/83
6,823,857 B2 * 11/2004 Perry et al. ..... 124/84
6,959,509 B2 * 11/2005 Vais ..... 42/75.02
7,036,259 B2 * 5/2006 Beretta ..... 42/75.02
7,076,904 B1 * 7/2006 Rustick ..... 42/75.02
7,076,905 B2 * 7/2006 Zouboulakis ..... 42/76.01
7,380,570 B1 * 6/2008 Orr ..... 137/625.25
7,392,803 B2 * 7/2008 Liao ..... 124/83
7,441,557 B2 * 10/2008 Judson ..... 124/83
7,628,149 B1 * 12/2009 Zarecky et al. ..... 124/85
7,691,759 B2 * 4/2010 Perry et al. ..... 442/77
8,087,194 B1 * 1/2012 Vuksanovich ..... 42/75.02

(Continued)

*Primary Examiner* — Gene Kim
*Assistant Examiner* — Alexander Niconovich
(74) *Attorney, Agent, or Firm* — Ming Chow; Sinorica, LLC

(57) ABSTRACT

An initial velocity accelerating tube includes an outer pipe. Two ends of the outer pipe are connected with a stop member and a connection member, respectively. An inner pipe is provided in the outer pipe. Two ends of the inner pipe are inserted in the stop member and the connection member, respectively. When the initial velocity accelerating tube is mounted on a toy gun, one end of the inner pipe is against the front end of the barrel of the toy gun by the elastic force of the elastic member so as to tightly connect the barrel, providing an airtight effect. The barrel can be lengthened. To have a shoot with the long-barreled gun, the bullet can have a longer route to accelerate for getting a higher initial velocity.

8 Claims, 5 Drawing Sheets

U.S. PATENT DOCUMENTS 8,240,074 B2 * 8/2012 Vuksanovich ..... 42/75.02
2003/0041849 A1 * 3/2003 Perry et al. ..... 124/84
2005/0066954 A1 * 3/2005 Williams ..... 124/83
2007/0240697 A1 * 10/2007 Liao ..... 124/83

* cited by examiner

INITIAL VELOCITY ACCELERATING TUBE

BACKGROUND OF THE INVENTION

1. Field of the Invention

The present invention relates to an initial velocity accelerating tube for a toy gun.

2. Description of the Prior Art

A toy gun has a main body and a barrel in the main body. One end of the barrel has a muzzle, and the other end of the barrel is connected with a percussion mechanism. The percussion mechanism uses a cylinder to push air for firing bullets. The bullets move along the barrel for shooting. According to the physical law, the initial velocity of the bullet and the route are in a direct ratio. In other words, the higher the initial velocity is, the farther object will be shot. The initial velocity of the bullet depends on the length of the barrel. When the toy gun is fired, the gas will be ejected through the percussion mechanism until the bullet reaches the muzzle. That is to say, the longer the barrel is, the longer accelerating route will be got after firing the bullet for getting more kinetic energy to have a higher initial velocity. However, in consideration of reality and carrying, the length of the toy gun is limited. In these days, the length of the barrel is shortened, which results in that the initial velocity of the toy gun cannot be increased. Accordingly, the inventor of the present invention has devoted himself based on his many years of practical experiences to solve this problem.

SUMMARY OF THE INVENTION

The primary object of the present invention is to provide an initial velocity accelerating tube which is convenient to carry and assemble and can increase the initial velocity of shooting for the toy gun.

According to the present invention, there is provided an initial velocity accelerating tube mounted at a front end of a barrel of a toy gun. The initial velocity accelerating tube comprises an outer pipe, a stop member, a connection member, an inner pipe, and an elastic member. The outer pipe has a first opening and a second opening at two ends thereof. The stop member is disposed at the first opening of the outer pipe. The stop member has an axial hole. The connection member is disposed at the second opening of the outer pipe. The connection member has a through hole corresponding to the axial hole of the stop member. The connection member further includes a connection portion to connect with the toy gun. The inner pipe is disposed in the outer pipe. Two ends of the inner pipe are inserted in the axial hole and the through hole, respectively. The inner pipe includes a first limit member on an outer wall thereof close to the stop member and a second limit member on the outer wall close to the connection member. The elastic member is disposed on the inner pipe and located between the first limit member and the stop member.

When the initial velocity accelerating tube of the present invention is mounted on the toy gun, the inner pipe has the end connected to the connection member to hold against the front end of the barrel of the toy gun by the elastic force of the elastic member so as to tightly connect the barrel, providing an airtight effect. In this way, the barrel can be lengthened. Thus, to have a shoot with the long-barreled gun, the bullet can have a longer route to accelerate for getting a higher initial velocity.

DETAILED DESCRIPTION OF THE PREFERRED EMBODIMENTS

Embodiments of the present invention will now be described, by way of example only, with reference to the accompanying drawings.

Figure 1:
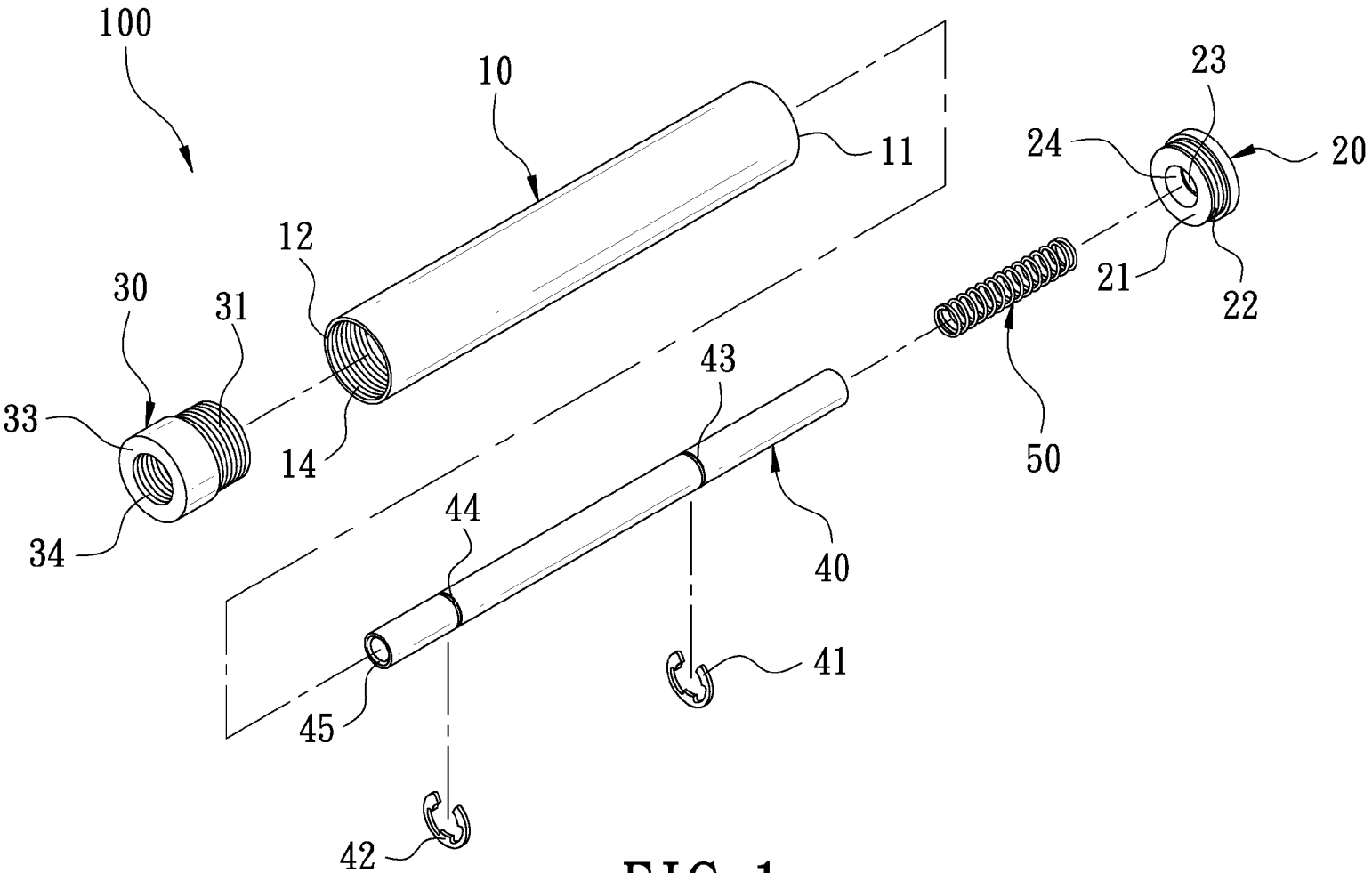
FIG. 1 is an exploded view according to a preferred embodiment of the present invention.
Figure 2:
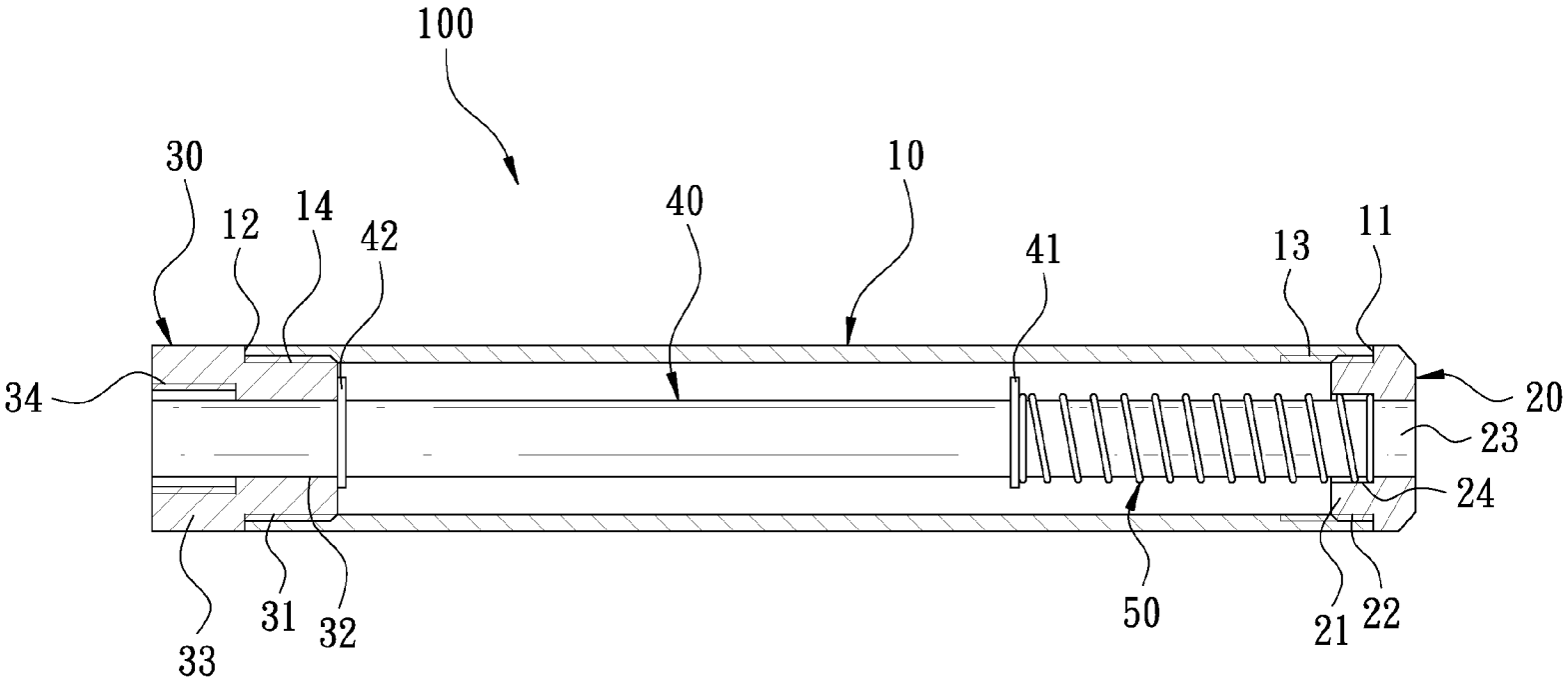
FIG. 2 is a cross-sectional view according to the preferred embodiment of the present invention.

As shown in FIG. 1 and FIG. 2, an initial velocity accelerating tube 100 according to a preferred embodiment of the present invention comprises an outer pipe 10, a stop member 20, a connection member 30, an inner pipe 40, and an elastic member 50.

The outer pipe 10 has a length ranged from 15 to 30 centimeters. The outer pipe 10 has a first opening 11 and a second opening 12 at two ends thereof. An inner wall of the outer pipe 10 has first inner threads 13 close to the first opening 11 and second inner threads 14 close to the second opening 12.

The stop member 20 is disposed at the first opening 11 of the outer pipe 10. The stop member 20 may be integrally formed with the outer pipe 10. In this embodiment, the stop member 20 has a protruding portion 21 at one end thereof. The protruding portion 21 has a diameter smaller than that of the stop member 20. The protruding portion 21 has outer threads 22 on an outer wall thereof. The stop member 20 is threadedly connected to the first opening 11 of the outer pipe 10. The stop member 20 has an axial hole 23. The protruding portion 21 has a trough 24 communicating with the axial hole 23. The trough 24 has a diameter greater than that of the axial hole 23.

The connection member 30 has outer threads 31 on an outer surface at one end thereof, so that the connection member 30 is threadedly connected to the second opening 12 of the outer pipe 10. The connection member 30 has a through hole 32 corresponding to the axial hole 23 of the stop member 20. The connection member 30 includes a connection portion 33 at another end thereof opposite to the stop member 20. In this embodiment, the connection portion 33 is a protruding block which has a diameter greater than that of the connection member 30. The connection portion 33 has a central threaded hole 34 which is coaxial with the through hole 32. The threaded hole 34 communicates with the through hole 32.

The inner pipe 40 is disposed in the outer pipe 10. Two ends of the inner pipe 40 are inserted in the axial hole 23 of the stop member 20 and the through hole 32 of the connection member 30, respectively. The inner pipe 40 includes a first limit member 41 on an outer wall thereof close to the stop member 20 and a second limit member 42 on the outer wall close to the connection member 30. In the embodiment, the outer wall of the inner pipe 40 has a first annular groove 43 corresponding to the first limit member 41 and a second annular groove 44 corresponding to the second limit member 42. The first limit member 41 and the second limit member 42 have a C-like shape and are engaged in the first annular groove 43 and the second annular groove 44. Furthermore, the inner pipe 40 has an enlarged opening 45 at the end connected to the connection member 30.

The elastic member 50 is disposed on the inner pipe 40 and located between the first limit member 41 and the stop member 20. In this embodiment, the elastic member 50 is a spring fitted on the inner pipe 40. One end of the elastic member 50 is inserted in the trough 24 of the stop member 20 and another end of the elastic member 50 is against the first limit member 41, so that the inner pipe 40 has a force to move toward the connection member 30.

Figure 3:
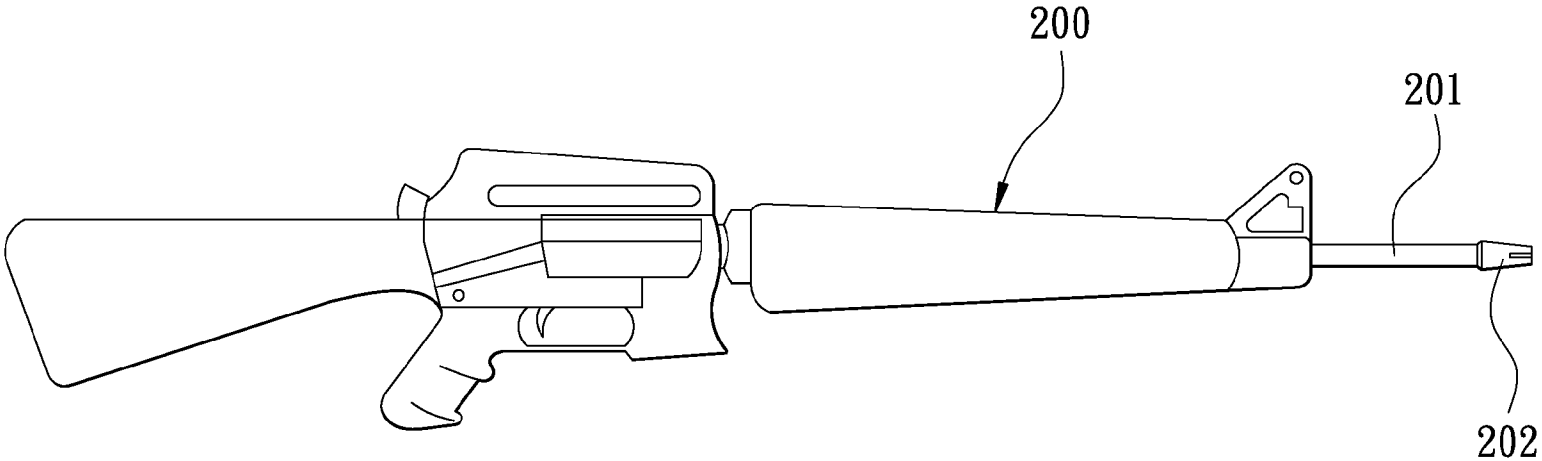
FIG. 3 is a schematic view showing the preferred embodiment of the present invention mounted on a long-barreled gun.
Figure 4:
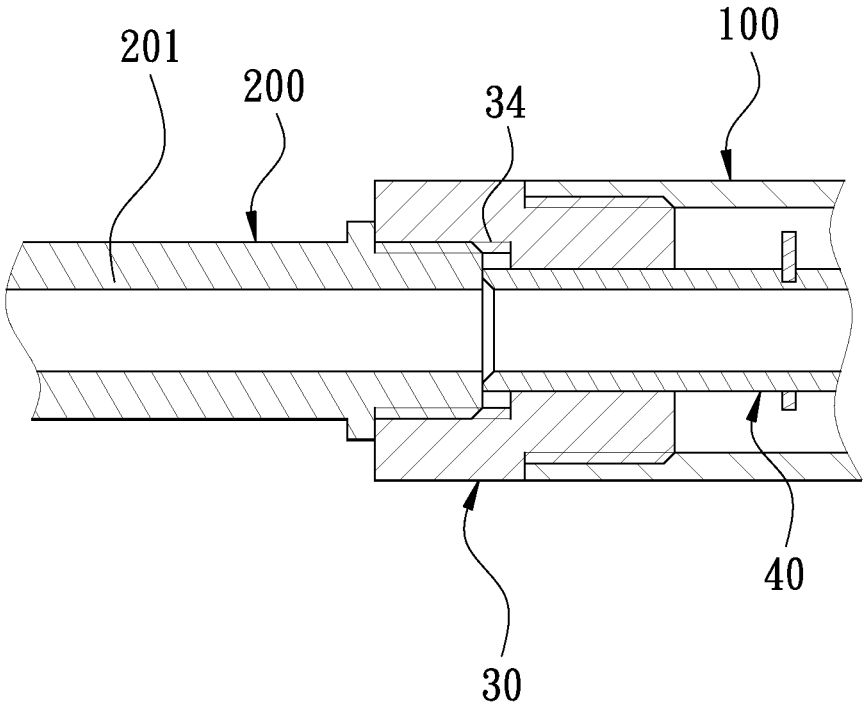
FIG. 4 is an enlarged cross-sectional view of FIG. 3 showing the front end of the barrel according to the preferred embodiment of the present invention.
Figure 5:
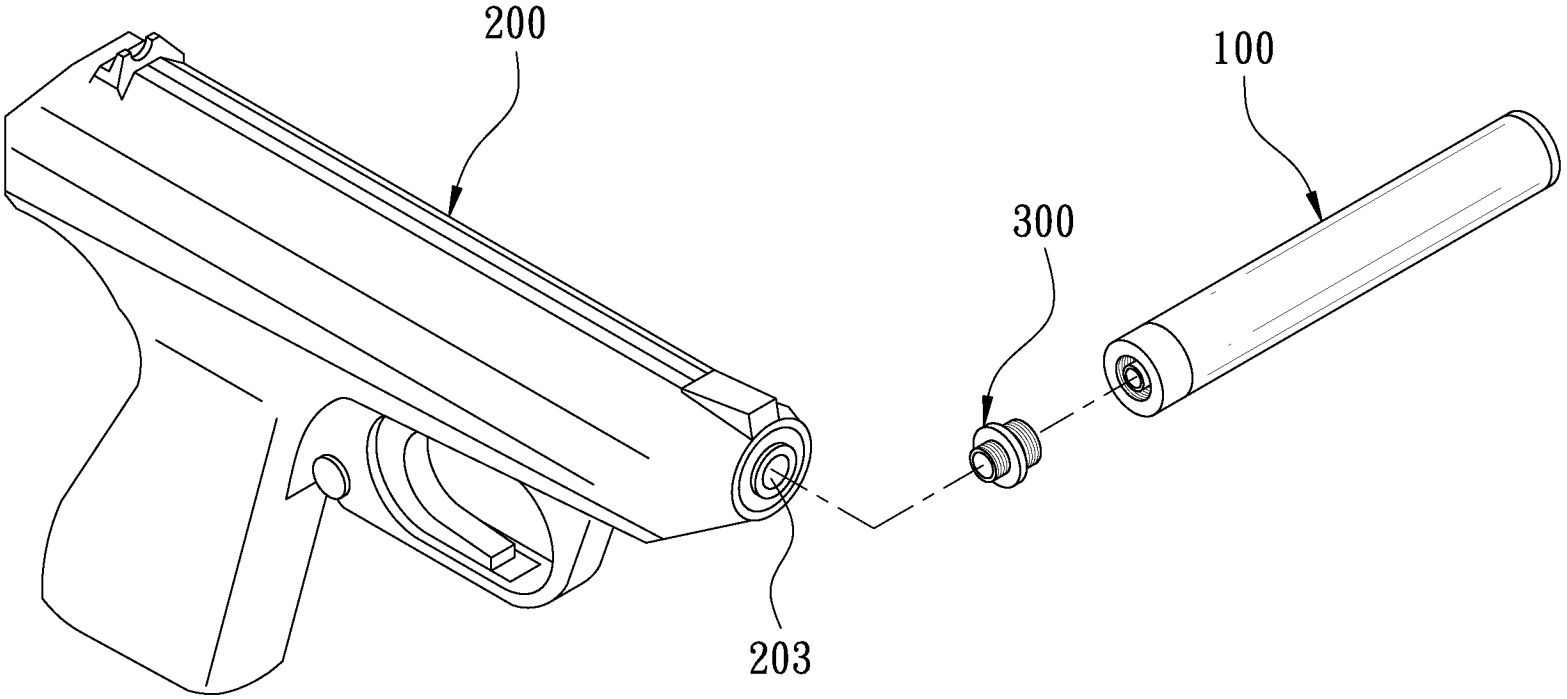
FIG. 5 is a schematic view showing the preferred embodiment of the present invention mounted on a short-barreled gun.

FIG. 3 and FIG. 4 show that the present invention is mounted on a long-barreled gun. FIG. 5 shows that the present invention is mounted on a short-barreled gun. The user can mount the initial velocity accelerating tube 100 at the front end of the barrel 201 of a toy gun 200. The toy gun 200 can be a long-barreled gun or a short-barreled gun. As shown in FIG. 3, the toy gun 200 is a long-barreled gun. The user just takes out a lid 202 which is screwed to the front end of the barrel of the long-barreled gun, and the initial velocity accelerating tube 100 is screwed to the long-barreled gun to complete the assembly. As shown in FIG. 4, the inner diameter of the barrel 201 of the long-barreled gun is equal to the inner diameter of the inner pipe 40, so the front end of the barrel 201 will push the inner pipe 40 to move toward the stop member 20. The inner pipe 40 has the end connected to the connection member 30 to be against the front end of the barrel 201 by the elastic force of the elastic member 50, with the enlarged opening 45 to tightly connect the barrel 201 so as to provide an airtight effect. In this way, the barrel 201 can be lengthened. Thus, to have a shoot with the long-barreled gun, the bullet can have a longer route to accelerate for getting a higher initial velocity. Based on a test, the outer pipe 10 of the present invention is controlled between 15 and 30 centimeters, the initial velocity of the bullet can be enhanced 15% to 35%, providing a significant effect. As shown in FIG. 5, when the user wants to mount the initial velocity accelerating tube 100 to a short-barreled gun, the muzzle 203 of the toy gun 200 is connected with a connecting element 300 which is a standard fitting for a short-barreled gun and connected with a gun silencer, and then the initial velocity accelerating tube 100 is screwed to the connecting element 300 through the threaded hole 34 of the connection member 33 to complete the assembly. The present invention can enhance the initial velocity of the short-barreled gun effectively.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An initial velocity accelerating tube mounted at a front end of a barrel of a toy gun, comprising:

an outer pipe having a first opening and a second opening at two ends thereof;

a stop member disposed at the first opening of the outer pipe, the stop member having an axial hole;

a connection member disposed at the second opening of the outer pipe, the connection member having a through hole corresponding to the axial hole of the stop member, the connection member further including a connection portion to connect with the toy gun;

an inner pipe disposed in the outer pipe, two ends of the inner pipe being respectively inserted in the axial hole and the through hole, the inner pipe including a first limit member an outer wall thereof close to the stop member and a second limit member on the outer wall close to the connection member;

the outer wall of the inner pipe has a first annular groove corresponding to the first limit member and a second annular groove corresponding to the second limit member, the first limit member and the second limit member having a C-like shape and being engaged in the first annular groove and the second annular groove;

an elastic member disposed on the inner pipe and located between the first limit member and the stop member; and the elastic member is a spring fitted on the inner pipe.

2. The initial velocity accelerating tube as claimed in claim 1, wherein the stop member is integrally formed with the outer pipe.

3. The initial velocity accelerating tube as claimed in claim 1, wherein an inner wall of the outer pipe has first inner threads close to the first opening, the stop member having a protruding portion at one end thereof, the protruding portion having outer threads on an outer wall thereof to be screwed to the first opening of the outer pipe.

4. The initial velocity accelerating tube as claimed in claim 3, wherein the protruding portion has a trough corresponding to the elastic member.

5. The initial velocity accelerating tube as claimed in claim 1, wherein an inner wall of the outer pipe has second inner threads close to the second opening, the connection member having outer threads on an outer surface thereof to be screwed to the second opening of the outer pipe.

6. The initial velocity accelerating tube as claimed in claim 1, wherein the connection portion is a protruding block which has a diameter greater than that of the connection member, the connection portion having a central threaded hole which is coaxial with the through hole, the threaded hole communicating with the through hole.

7. The initial velocity accelerating tube as claimed in claim 1, wherein the outer pipe has a length ranged from 15 to 30 centimeters.

8. The initial velocity accelerating tube as claimed in claim 1, wherein the inner pipe has an enlarged opening at the end connected to the connection member.

* * * * *